US005832907A

United States Patent [19]

Kato

[11] Patent Number: 5,832,907

[45] Date of Patent: Nov. 10, 1998

[54] ENGINE FEEDBACK CONTROL SYSTEM

[75] Inventor: Masahiko Kato, Hamamatsu, Japan

[73] Assignee: Sanshin Kogyo Kabushiki Kaisha, Hamamatsu, Japan

[21] Appl. No.: 841,288

[22] Filed: Apr. 29, 1997

[30] Foreign Application Priority Data

Apr. 30, 1996 [JP] Japan ..... 8-109307

[51] Int. Cl.[6] ..... F02D 41/14

[52] U.S. Cl. ..... 123/672; 60/276; 123/65 R

[58] Field of Search ..... 60/276; 123/65 R, 123/672, 676, 703

[56] References Cited

U.S. PATENT DOCUMENTS 4,831,820 5/1989 Lassanske ..... 60/276
4,903,648 2/1990 Lassanske ..... 123/65 R
5,613,480 3/1997 Katoh et al. ..... 123/673 X
5,711,148 1/1998 Katoh ..... 60/276

*Primary Examiner*—Tony M. Argenbright
*Attorney, Agent, or Firm*—Knobbe, Martens, Olson & Bear LLP

[57] ABSTRACT

An improved feedback control system and method for internal combustion engines that permits extremely accurate feedback control. This is done by utilizing a sensor device that is interrelated with the combustion chambers of the engine so that it only samples the gases from the engine at a time after the exhaust port has opened and before any fresh air charge enters the combustion chamber. By doing this, it is possible to ensure that only combustion product reach the sensor and the sensor chamber will have a time to purge itself of the combustion products from one cylinder before another sampling takes place. This is described in conjunction with both two and four-cycle engines.

22 Claims, 11 Drawing Sheets

ENGINE FEEDBACK CONTROL SYSTEM

BACKGROUND OF THE INVENTION

This invention relates to an engine control and more particularly to an improved feedback type of engine control.

In order to improve the performance of internal combustion engines, a wide variety of control systems has been proposed. One of the most popular and successful type of control system is the so-called "feedback control" system. With such a system, a sensor is provided for sensing the combustion conditions in the combustion chamber. The output of this sensor is then utilized to adjust the fuel-air charging system to provide the desired or optimum control. This type of system has the advantage of lending itself to actual cycle to cycle adjustments.

One type of sensor which is commonly utilized for feedback control is the oxygen ($O_2$) sensor. An oxygen sensor senses the amount of oxygen in the exhaust gases from the cylinder. From this, it is possible to determine the actual air-fuel ratio, or more specifically, whether fuel-air ratio is stoichiometric or not.

Although this type of control permits cycle-to-cycle adjustment, there are certain problems in connection with achieving this result. Specifically, the sensor must be positioned in a location where it can sense the exhaust gases as they emanate from the combustion chamber or within the combustion chamber at the end of combustion. Although this seems simple in principle, it practice it is not so simple.

The reason for this is that if the sensor is placed directly in the combustion chamber, it can become damaged. Furthermore, the sensor will be subject to a wide variety of conditions during the cycling of the engine through its various cycles and the output will be erratic as a result of this cycling.

There have been proposed, therefore, systems where the sensor communicates with the combustion chamber in a position where the exhaust gases will be at the state where combustion has completed or nearly completed. However, this requires moving of the exhaust gases from the actual cylinder into a chamber where the sensor is positioned and then disposing of those gases before the next combustion cycle. The gases must be disposed of so that a residual amount does not stay in place and interfere with the succeeding sampling. This goal is difficult to achieve.

Another problem which is particularly prevalent with two-cycle engines but is not necessarily limited thereto is that if the timing of sensing of the charge is delayed, there may be a fresh charge entering the combustion chamber. This fresh charge can mix with the previously burned charge and give erroneous results. As a result, the data which is collected is not accurate and poor control will result.

It is therefore a principal object of this invention to provide an improved method and apparatus for providing feedback control for an internal combustion engine.

It is a still further object of this invention to provide an engine control and method wherein the exhaust gases can be accurately sampled on a cycle-to-cycle basis without extraneous or interfering readings.

SUMMARY OF THE INVENTION

This invention is adapted to be embodied in an internal combustion engine and control method therefore. The engine comprises a combustion chamber. An induction and charge-forming system supplies fuel and air to the combustion chamber through an inlet port. Means are incorporated for igniting the charge in the combustion chamber for initiating combustion therein. Exhaust means discharging exhaust gases from the combustion chamber through an exhaust port to the atmosphere. A combustion condition sensor senses combustion condition in the combustion chamber and provides an output signal indicative of the combustion condition. Feedback control means control the charge-forming system for varying the fuel/air ratio supplied to the combustion chamber in response to the output signal from the combustion condition sensor.

An engine embodying the invention includes means for reading the condition of the combustion chamber gases only at a time when the exhaust port is initially opened.

A method for controlling the engine embodies the sensing of the output signal from the combustion condition sensor at the time when the exhaust port is initially opened.

DETAILED DESCRIPTION OF THE PREFERRED EMBODIMENTS OF THE INVENTION

Figure 1:
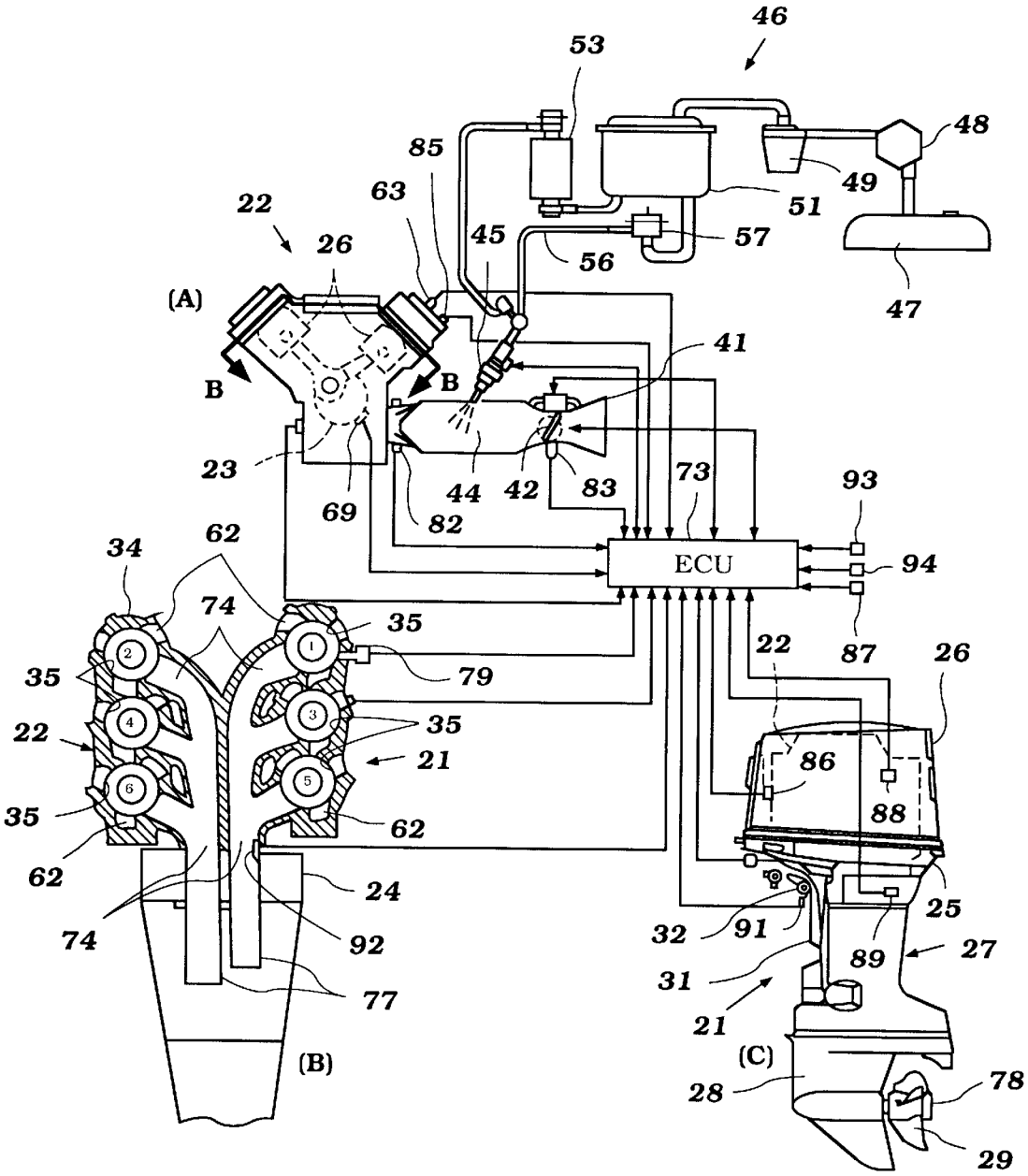
FIG. 1 is a partially schematic three part view showing an outboard motor constructed and operated in accordance with an embodiment of the invention (C) in side elevation, (B)in rear plan with a portion of the protective cowling removed and a part of the engine broken away along the line B—B of view portion A and (A) in a schematic top plan view of the engine with the fuel supply system and feedback control system being shown in part schematically.
Figure 2:
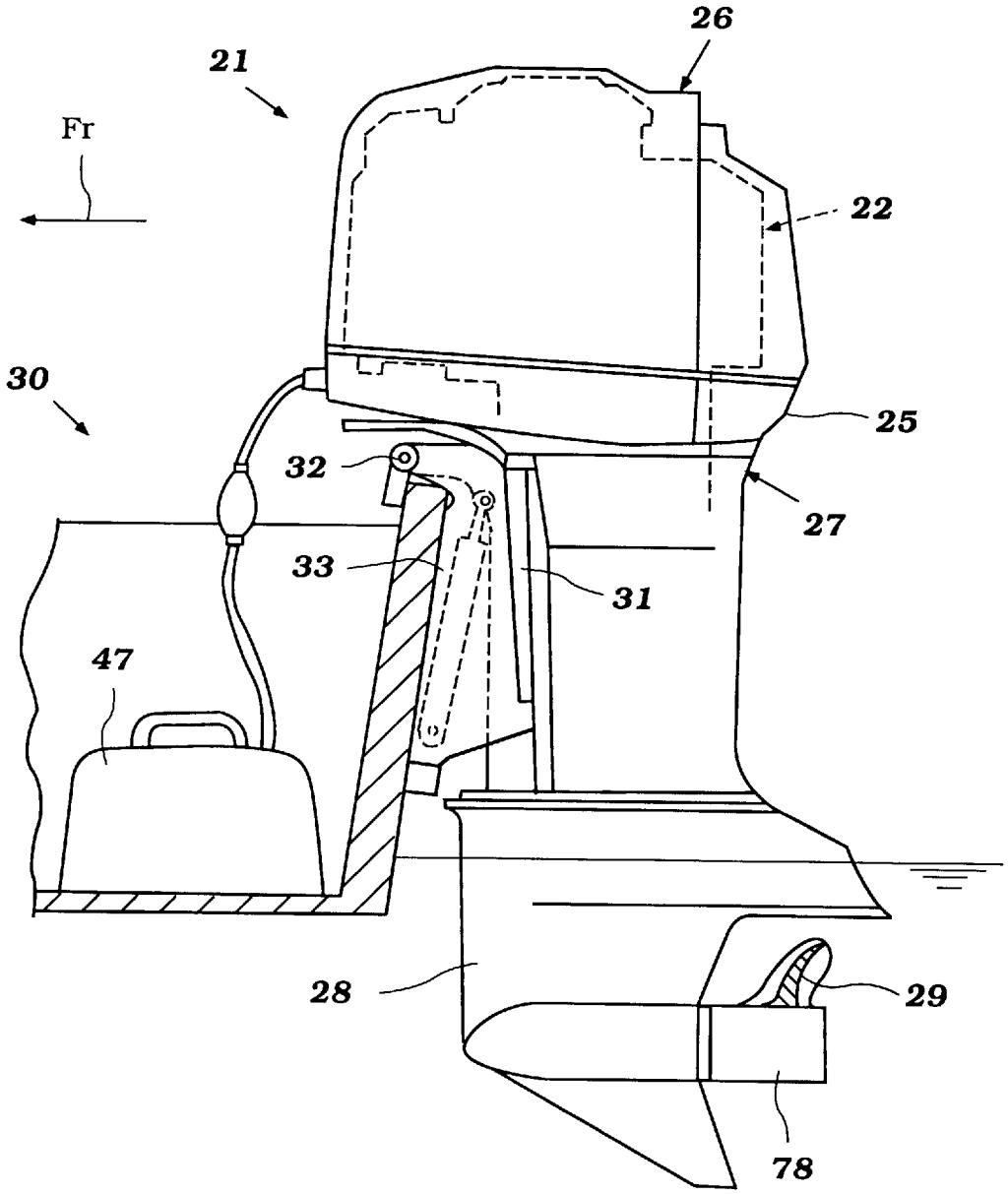
FIG. 2 is an enlarged side elevational view of the outboard motor.

Referring now in detail to the drawings, and to the embodiment of FIGS. 1–9 initially by reference to FIGS.

1–5, an outboard motor is indicated generally by the reference numeral 21. The invention is shown in conjunction with an outboard motor because the invention has particular utility in conjunction with two-cycle crankcase compression engines even though not specifically limited thereto. Such engines are normally used as the propulsion device for outboard motors. For these reasons, the full details of the outboard motor 21 will not be described and have not been illustrated. Those skilled in the art can readily understand how the invention can be utilized with any known type of outboard motor.

The outboard motor 21 includes a power head that is comprised of a powering internal combustion engine, indicated generally by the reference numeral 22. The construction of the engine 22 will be described later, but it should be noted that the engine 22 is mounted in the power head so that its crankshaft, indicated by the reference numeral 23, rotates about a vertically extending axis. The engine 22 is mounted on a guide plate 24 provided at the lower end of the power head and the upper end of a drive shaft housing, to be described. Finally, the power head is completed by a protective cowling comprised of a lower tray portion 25 and a detachable upper main cowling portion 26.

The engine crankshaft 23 is coupled to a drive shaft (not shown) that depends into and is rotatably journaled within the afore noted drive shaft housing, which is indicated by the reference numeral 27. This drive shaft then continues on to drive a forward/neutral/reverse transmission, which is not shown but which is contained within a lower unit 28. This transmission provides final drive to a propeller 29 in any known manner for propelling an associated watercraft shown in FIG. 2 and identified by the reference numeral 30.

A steering shaft (not shown) is affixed to the drive shaft housing 27. This steering shaft is journaled for steering movement within a swivel bracket 31 for steering of the outboard motor 21 and the associated watercraft 30 in a well-known manner.

The swivel bracket 31 is, in turn, pivotally connected by a pivot pin 32 to a clamping bracket 33 that is adapted to be detachably affixed to the transom of the associated watercraft. The pivotal movement about the pivot pin 32 accommodates trim and tilt-up operation of the outboard motor 21, as is well known in this art.

Continuing to refer to FIG. 1 and now primarily to the lower left-hand side view and the upper view, the engine 22 is depicted as being of the two-cycle crankcase compression type and, in the specific illustrated embodiment, is of V six configuration. Although this particular cylinder configuration is illustrated, it will be apparent to those skilled in the art how the invention may be employed with engines having other numbers of cylinders and other cylinder orientations. In fact, certain facets of the invention may also be employed with rotary or other ported type engines and even with four cycle engines and two such embodiments appear in FIGS. 12 and 13.

The engine 22 includes a cylinder block 34 having a pair of angularly disposed cylinder banks in each of which three cylinder bores 35 are formed. Pistons 36 reciprocate in these cylinder bores 35 and are connected by means of connecting rods 37 to the crankshaft 23. The crankshaft 23 is, in turn, journaled for rotation within a crankcase chamber 38 in a suitable manner. The crankcase chamber 38 is formed by the cylinder block 34 and a crankcase member 39 that is affixed to it in any known manner.

As is typical with two-cycle crankcase compression engine practice, the crankcase chambers 38 associated with each of the cylinder bores 35 are sealed relative to each other in an appropriate manner. A fuel-air charge is delivered to each of the crankcase chambers 28 by an induction system which is comprised of an atmospheric air inlet device 41 (FIGS. 1,3 and 4) which draws atmospheric air through an inlet formed within the protective cowling.

A throttle body assembly 40 having throttle valves 42 is positioned downstream of the air inlet 41 and is operated in any known manner.

Finally, the intake system discharges into intake ports 43 formed in the crankcase member 39. Reed-type check valves 44 are provided in each intake port 43 for permitting the charge to be admitted to the crankcase chambers 38 when the pistons 36 are moving upwardly in the cylinder bore 35. These reed-type check valves 44 close when the piston 36 moves downwardly to compress the charge in the crankcase chambers 38, as is also well known in this art.

Fuel is added to the air charge inducted into the crankcase chambers 38 by a suitable charge former. In the illustrated embodiments, this charge former includes fuel injectors 45, each mounted in a respective branch of the intake manifold downstream of the respective throttle valve 42. The fuel injectors 45 are preferably of the electronically operated type. That is, they are provided with an electric solenoid that operates an injector valve so as to open and close and deliver high-pressure fuel directed toward the intake port 43.

Fuel is supplied to the fuel injectors 45 under high pressure through a fuel supply system, indicated generally by the reference numeral 46. This fuel supply system 46 includes a fuel tank 47 which is positioned remotely from the outboard motor 21 and preferably within the hull of the watercraft 30 propelled by the outboard motor 21. Fuel is pumped from the fuel tank 47 by means of a plurality of crankcase chamber pressure driven, low pressure, fuel pumps 48. This fuel is drawn through a fuel filter 49, which is mounted within the power head of the outboard motor 21.

Fuel flows from the fuel pumps 48 through a conduit into a fuel vapor separator 51, which includes a float controlled valve for controlling the level of fuel in the fuel vapor separator 51. Any accumulated vapor will condense, and excess vapor pressure can be relieved through a suitable vent (not shown).

Also mounted, preferably in the fuel vapor separator 51, is a high-pressure fuel pump 53 which is driven in any known manner as by an electric motor. This fuel pump 53 draws fuel from the fuel vapor separator 51 and delivers fuel under high pressure to a fuel rail 54 through a conduit 55. The fuel rail 54 serves each of the injectors 45 associated with the engine.

A return conduit 56 extends from the fuel rail 54 to a pressure regulator 57. The pressure regulator 57 controls the maximum pressure in the fuel rail 54 that is supplied to the fuel injectors 45. This is done by dumping excess fuel back to the fuel vapor separator 51 through a return line 58 (FIG. 1). The regulated pressure may be adjusted electrically along with other controls, as will be described.

The fuel-air charge which is formed by the charge-forming and induction system as thus far described is transferred from the crankcase chambers 38 to combustion chambers, indicated generally by the reference numeral 59, of the engine. These combustion chambers 59 are formed by the heads of the pistons 36, the cylinder bores 35, and a pair of cylinder head assemblies 61 that are affixed to the banks of the cylinder block 34 in any known manner. The charge so formed is transferred to the combustion chamber 59 from the crankcase chambers 38 through one or more scavenge passages 62 (See View B of FIG. 1).

These scavenge passages terminate in scavenge ports that open through the cylinder bores 35 and which are valved by the movement of the pistons 36, as is well known in the two cycle art.

Spark plugs 63 are mounted in the cylinder head 61 and have their spark gaps extending into the combustion chambers 59. The spark plugs 63 are fired by a capacitor discharge ignition system The ignition system is provided with electrical current by a magneto generator assembly, indicated generally by the reference numeral 64. This includes a flywheel 65 having a hub portion 66 that is fixed for rotation with the crankshaft 23 at the upper end thereof. This flywheel 65 carries a plurality of permanent magnets 67 that cooperate with charging coils 68 mounted on the upper end of the engine. In addition, a pulser coil 69 is associated with the crankshaft for providing a pulse signal when the crankshaft rotates which signal is indicative of the rotational speed and angular position of the crankshaft 23.

The magneto generator 64 outputs is electrical current to the CDI ignition system, which is shown schematically at 71 and which may be conveniently mounted in an appropriate location. This outputs a signal to a spark coil which may be mounted on each spark plug 63 for firing the spark plugs 63 in a known manner.

The capacitor discharge ignition circuit is operated, along with certain other engine controls such as the regulated fuel pressure, by an engine management ECU, shown schematically and identified generally by the reference numeral 73.

When the spark plugs 63 fire, the charge in the combustion chambers 59 will ignite and expand so as to drive the pistons 36 downwardly. The combustion products are then discharged through exhaust ports formed in the cylinder block 34. Like the scavenge ports, the exhaust ports are valved by the movement of the pistons.

Figure 3:
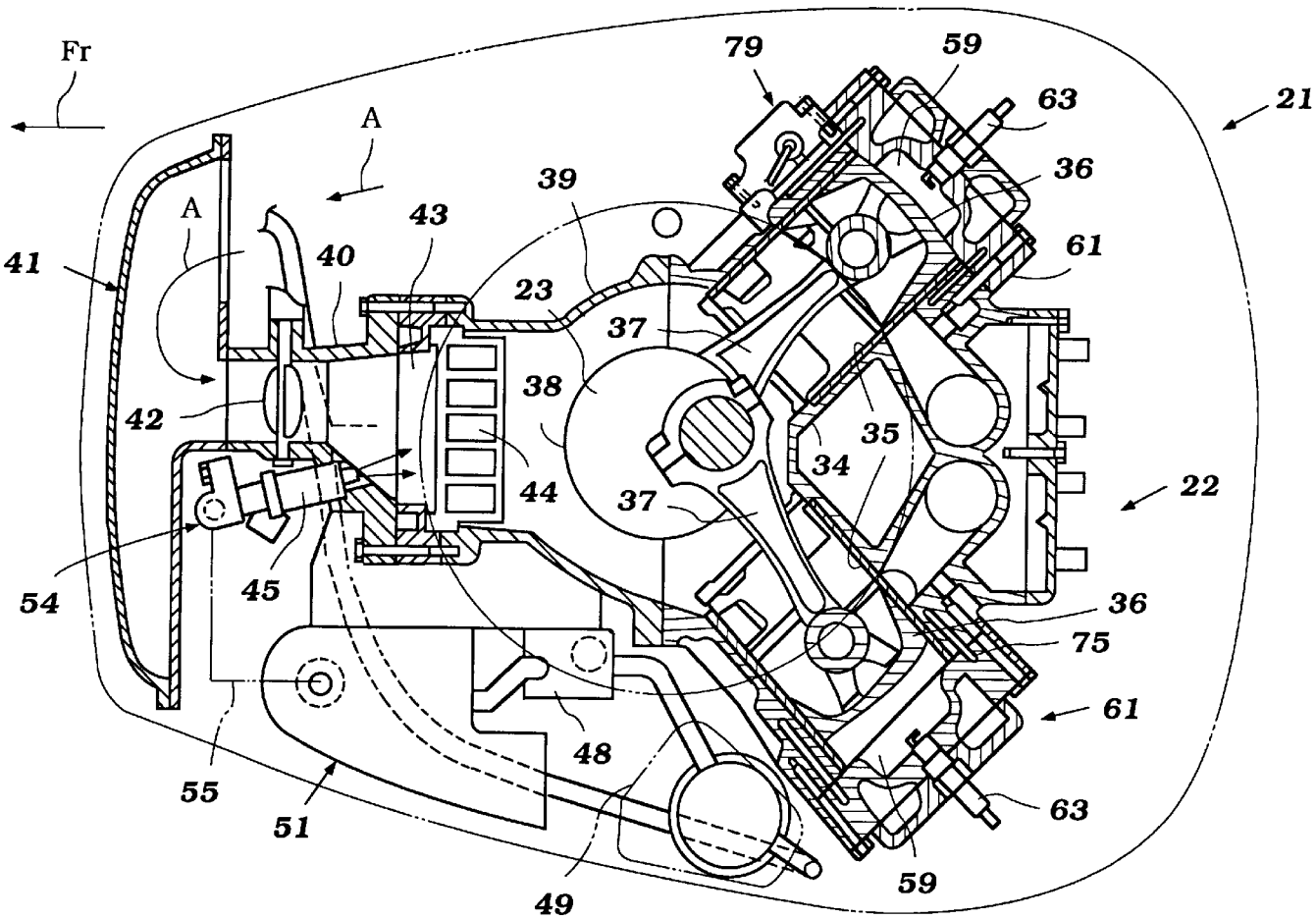
FIG. 3 is a top plan view of the power head of this embodiment with the protective cowling shown in phantom, and the engine shown broken away and in section.
Figure 4:
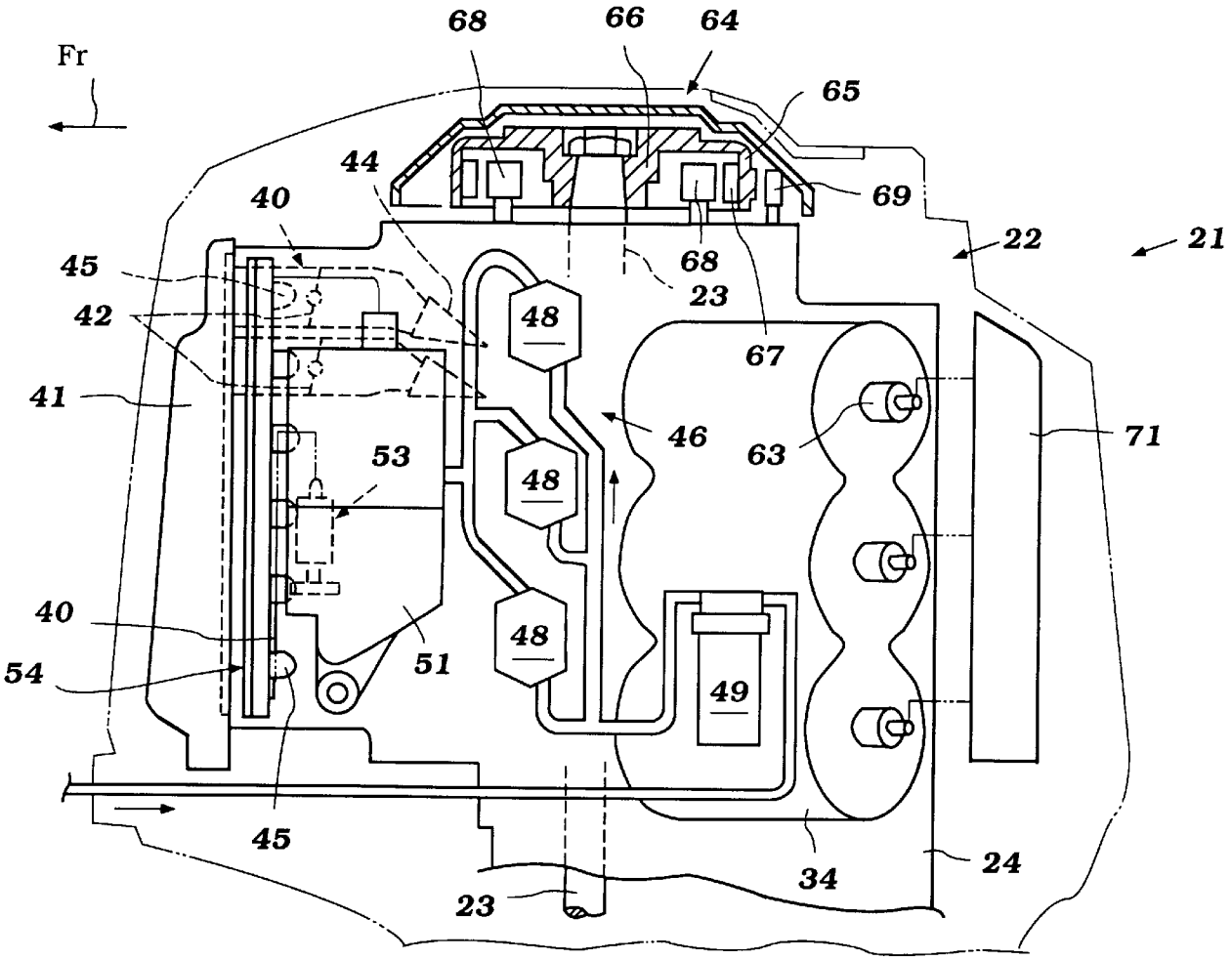
FIG. 4 is a side elevational view of the components shown in FIG. 3 with other portions broken away.

These exhaust gases then flow through a pair of exhaust manifolds, shown in FIGS. 1 and 3 and identified by the reference numeral 74. The exhaust gases then pass downwardly through an opening in the guide plate 24 to an appropriate exhaust system (to be described later) for discharge of the exhaust gases to the atmosphere. Conventionally, the exhaust gases are discharged through a high-speed under-the-water discharge and a low-speed, above-the-water discharge. The systems may be of any type known in the art.

The engine 22 is water cooled, and for this reason, the cylinder block 34 is formed with a cooling jacket 75 to which water is delivered from the body of water in which the watercraft is operating. Normally, this coolant is drawn in through the lower unit 28 by a water pump positioned at the interface between the lower unit 28 and the drive shaft housing 27 and driven by the drive shaft. This coolant also circulates through a cooling jacket formed in the cylinder head 61. After the water has been circulated through the engine cooling jackets, it is dumped back into the body of water in which the watercraft is operating. This is done in any known manner and may involve the mixing of the coolant with the engine exhaust gases to assist in their silencing. This will also be described later.

Although not completely shown in the drawings, the engine 22 is also provided with a lubricating system for lubricating the various moving components of the engine 22. This system may spray lubricant into the intake passages in proximity to the fuel injector nozzles 45 and/or may deliver lubricant directly to the sliding surfaces of the engine 22.

Referring now primarily to FIG. 1, the exhaust system for discharging the exhaust gases to the atmosphere will be described. As has been noted, the exhaust manifolds 74 communicate with exhaust passages, indicated by the reference numeral 76, that is formed in the spacer or guide plate 24. Exhaust pipes 77 are affixed to the lower end of the guide plate 24 and receive the exhaust gases from the passages 76.

The exhaust pipes 77 depend into an expansion chamber formed within the outer shell of the drive shaft housing 27. This expansion chamber communicates with an exhaust chamber formed in the lower unit 28 and to which the exhaust gases flow.

A through-the-hub, high speed, exhaust gas discharge opening 78 is formed in the hub of the propeller 29 and the exhaust gases exit the outboard motor 22 through this opening below the level of water in which the watercraft 30 is operating when traveling at high speeds.

In addition to this high speed exhaust gas discharge, the outboard motor 21 may be provided with a further above-the-water, low speed, exhaust gas discharge (not shown). As is well know in this art, this above-the-water exhaust gas discharge is relatively restricted, but permits the exhaust gases to exit without significant back pressure when the watercraft 30 is traveling at a low rate of speed or is idling, and the through-the-hub exhaust gas discharge 78 will be deeply submerged.

As has been previously noted, the cooling water from the engine cooling jacket 75 may also be mixed with the exhaust gases at any suitable point or points in the exhaust system.

It has been noted that the ECU 73 controls the capacitor discharge ignition circuit and the firing of the spark plugs 63. In addition, the ECU controls the fuel injectors 45 so as to control both the beginning and duration of fuel injection and the regulated fuel pressure, as already noted. The ECU 73 may operate on any known strategy for the spark control and fuel injection control, although this system employs an exhaust sensor assembly indicated generally by the reference numeral 79. In addition, the ECU 73 may disable the firing of one or more of the spark plug 63 for a portion of the engine running time in response to certain conditions, such as low speed low load, so as to provide fuel economy.

So as to permit engine management, a number of sensors are employed. Some of these sensors are illustrated either schematically or in actual form, and others are not illustrated. It should be apparent to those skilled in the art, however, how the invention can be practiced with a wide variety of control strategies other than or in combination with those which form the invention.

The sensors as shown primarily in FIG. 1 include the aforementioned crankshaft position sensor 69 which senses the angular position of the crankshaft 23 and also the speed of its rotation. A crankcase pressure sensor 81 is also provided for sensing the pressure in the individual crankcase chambers 38. Among other things, this crankcase pressure signal may be employed as a means for measuring intake air flow and, accordingly, controlling the amount of fuel injected by the injector 45, as well as its timing.

A temperature sensor 82 may be provided in the intake passage downstream of the throttle valves 42 for sensing the temperature of the intake air. In addition, the position of the throttle valves 42 is sensed by a throttle position sensor 83. Engine temperature is sensed by a coolant temperature sensor 84 that is mounted in an appropriate area in the engine cooling jacket 75. An in-cylinder pressure sensor 85 may be mounted in the cylinder head 61 so as to sense the pressure in the combustion chamber 59. A knock sensor 86 may also be mounted in the cylinder block 34 for sensing the existence of a knocking condition.

Certain ambient conditions also may be sensed, such as atmospheric air pressure by a sensor 87, intake cooling water temperature, as sensed by a sensor 88, this temperature being the temperature of the water that is drawn into the cooling system before it has entered the engine cooling jacket 75.

In accordance with some portions of the control strategy, it may also be desirable to be able to sense the condition of the transmission for driving the propeller 29 or at least when it is shifted into or out of neutral. Thus, a transmission condition sensor 89 is mounted in the power head and cooperates with the shift control mechanism for providing the appropriate indication.

Furthermore, a trim angle sensor 91 is provided for sensing the angular position of the swivel bracket 31 relative to the clamping bracket 33.

Finally, the engine exhaust gas back pressure is sensed by a back pressure sensor 92 that is positioned within the expansion chamber which forms part of the exhaust system for the engine and which is positioned in the drive shaft housing 27.

Other conditions may also be sensed including conditions of the watercraft. These conditions are sensed by a vessel speed sensor 93 and a vessel trim condition sensor 94.

The types of sensors which may be utilized for the feedback control system provided by the ECU 73 are only typical of those which may be utilized in conjunction with the invention. For that reason, further details of the description of the components of the engine and outboard motor that have no particular importance in conjunction with the understanding of the construction and operation of the invention have been deleted.

The various cylinders of the engine will be identified since the oxygen sensor 79 is associated with more than one cylinder of the engine 22. In order to permit this description to be more clearly understood, the cylinders of the engine 22 have been numbered from top to bottom and from right bank and left bank successively as cylinder numbers 1 through 6.

Figure 5:
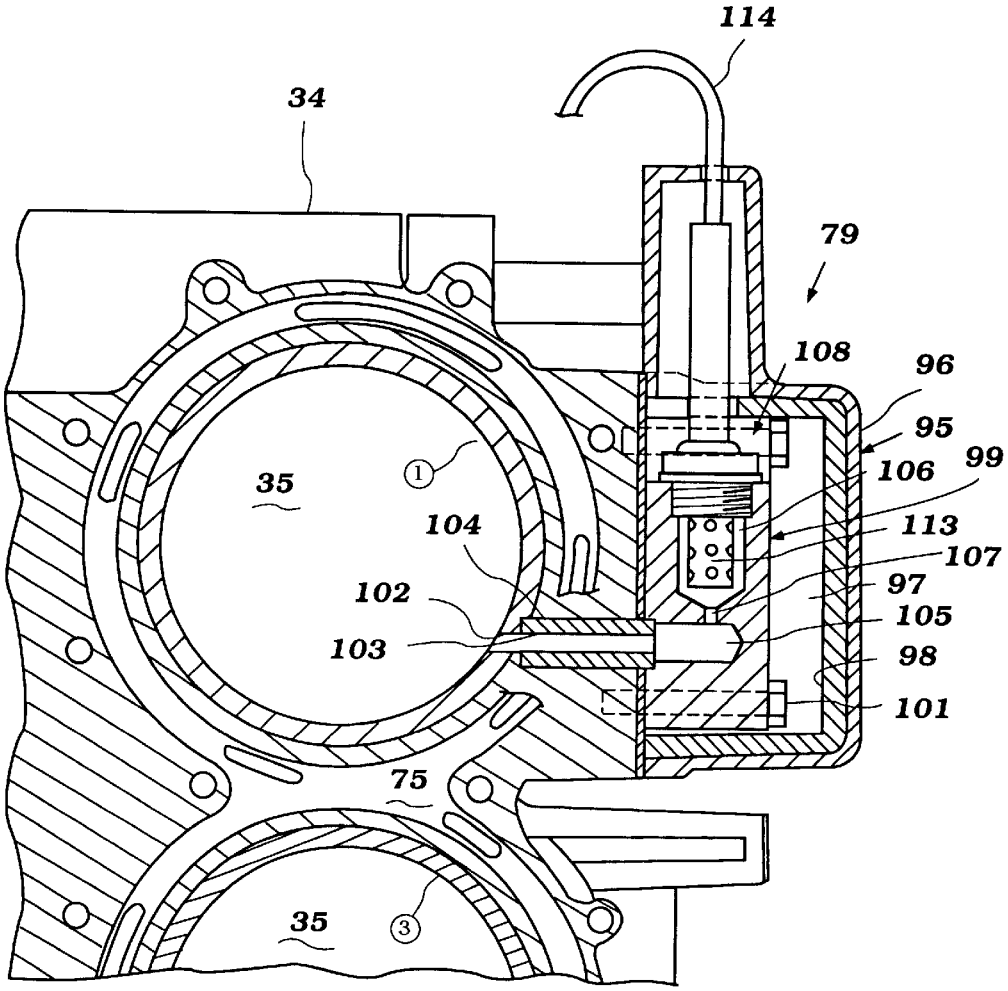
FIG. 5 is a cross-sectional view taken through one of the cylinder banks and depicts the oxygen sensor association therewith.
Figure 6:
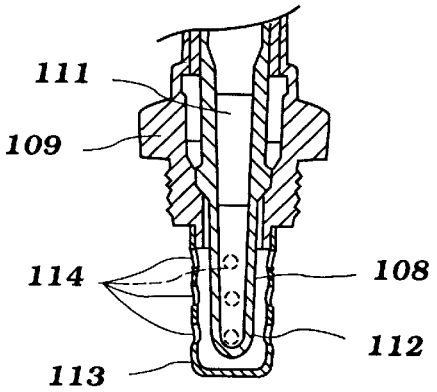
FIG. 6 is an enlarged cross-sectional view taken through the oxygen sensor and showing the actual sensing unit.

The sensor assembly 79 has a construction as best shown in FIGS. 5 and 6. The sensor assembly 79 is comprised of an outer housing assembly, indicated generally by the reference numeral 95. The outer housing assembly 95 is comprised of an outer part 96 which is formed from sheet metal or the like and which defines a cavity 97. The inner surface of the sheet metal member 96 is formed with an insulating lining 98. A further case 99 is mounted within this chamber 97 and is fixed to the cylinder block assembly 34 in proximity to number 1 cylinder by a plurality of threaded fasteners 101.

A small sensing port 102 is formed in the cylinder bore 95 in a position closely adjacent the height of the exhaust port of the number 1 cylinder and in a position to be described in more detail later by reference to FIG. 7. This is done so that burnt exhaust gases may pass through a passage 103 formed in a tube 104 that is pressed into the cylinder block and communicates with the passageway 102.

The passageway 103 of the tube 104 communicates with a chamber 105 formed in the member 99. This passageway further communicates with a sensor chamber 106 through a restricted orifice 107. The actual sensor element, indicated by the reference numeral 108 is mounted so as to extend into this chamber 106.

The sensor element itself 108 is mounted in a mounting fitting 109 that is threaded into the body 99. A heater element 111 transfers heat to the body 108. The body 108 is formed from a zirconia material that is plated onto a hollow glass tube.

This sensor element 108 has a hollow interior 112 and is surrounded by a protective shield 113 which has a tubular configuration and which is formed with openings 114 so the combustion products may reach the sensor element 108. A conduit 114 carries the signal from the sensor 108 to the ECU 73.

Figure 7:
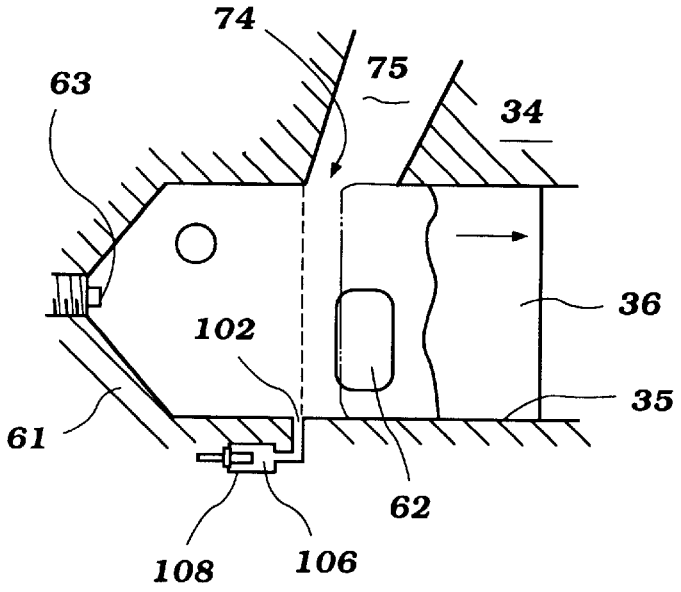
FIG. 7 is a partially schematic view showing the condition in a single cylinder of the engine and how the sensor operates to sample the exhaust gases at the appropriate time.

FIG. 7 is a schematic view that illustrates in part the principle by which the invention operates. As may be seen, the port 102 that communicates the sensor chamber 106 with the actual sensor element 108 is disposed so that it will be opened at a time when the piston reaches the position shown in the dotted line which is just shortly before the exhaust port which communicates with the exhaust passage 74 is open. As a result, at this instant, the sensor element 108 will see products of combustion that have substantially completely completed their combustion. However, there are two problems with this condition. The first is that the port 102 remains open as the piston 36 continues its downward movement and when the exhaust port is open. Furthermore, the scavenge ports 62 will open during further movement of the piston 36.

Thus a fresh fuel air charge will enter the combustion chamber and also pass through the passage 102 into the sensor chamber 106. The effect of this can cause the feedback control to be erratic or incorrect.

Figure 8:
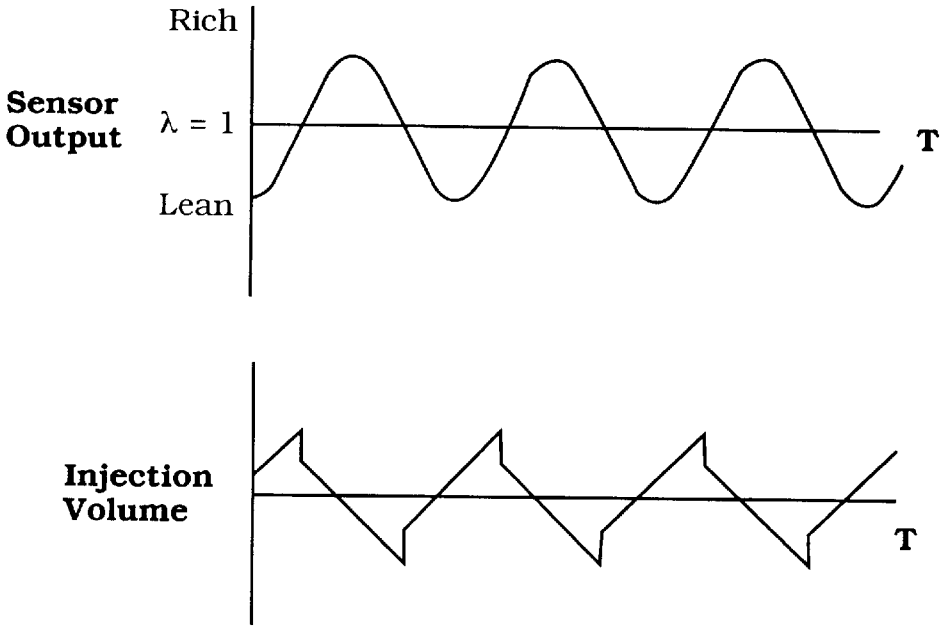
FIG. 8 is a graphical view showing in the upper portion the sensor output during normal engine running and in the lower view the amount of fuel actually supplied relative to time with the output signals noted in the upper view.

FIG. 8 shows how the feedback control is accomplished. The upper figure shows the output from the sensor 108 during engine running in accordance with time proceeding along the ordinate. It will be seen the sensor starts in this figure with a negative output indicating a lean mixture. At this time, the ECU 73 adjusts the fuel injectors 45 so as to provide an enriched mixture by increasing the amount of fuel injected per cycle as shown in the lower portion of this figure.

The sensor output will then move towards the rich side and as it crosses over the stoichiometric line will stay rich. Then the ECU sends out a signal that causes the fuel mixture to be leaned first in a large increment and then gradually in smaller increments until the sensor output again falls. This cycle repeats as the engine running continues.

In accordance with the invention, a timer circuit is incorporated in the interconnection between the sensor element 108 and the ECU 73 so that the output of the sensor is lead only during the brief time period when exhaust gases will actually represent the combustion condition at the end of combustion in the combustion chamber. This may be understood by reference to FIG. 9.

Figure 9:
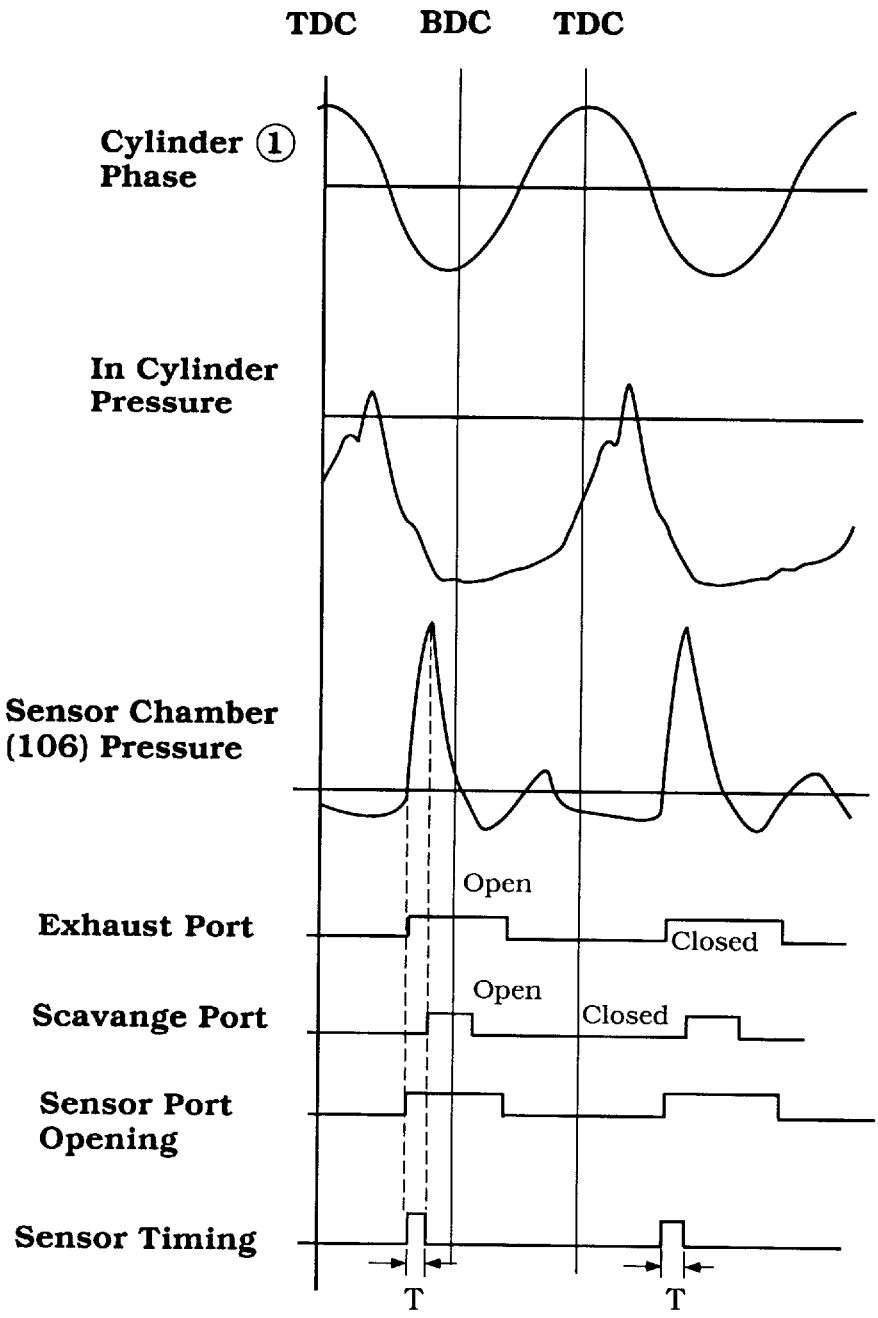
FIG. 9 is a graphical view showing from top to bottom the cylinder phase, inside cylinder pressure, pressure in the sensor chamber, exhaust port timing, scavenged port timing, exhaust gas guide port timing, and the sensor detection timing in accordance with the invention.

In FIG. 9, and at the top of this view, there is a curve showing the rotational position of the crankshaft. The next curve down shows the actual pressure in the cylinder. The third curve shows the actual pressure in the sensor chamber 106. It will be seen that this pressure lags somewhat the actual in cylinder pressure.

The port timings are shown at the lower portion of this figure. In accordance with the invention, the time at which the output of the sensor element 108 is read is limited to a narrow time period T that begins at the time when the exhaust port opens and which ends before the scavenge port opens. In this way, it is possible to capture and read only the condition of the burnt gases in the combustion chamber and thus an accurate reading is taken.

During the succeeding interval, the sensor chamber 106 can purge itself of the charge so that during the next sensing cycle it will actually sense only combustion products from the next burning cycle. This is because the pressure that has been actually sensed in the chamber was the pressure from the previous cycle and it will have been depleted during the succeeding portion of the stroke as seen by the pressure curve in the reaction chamber.

Figure 10:
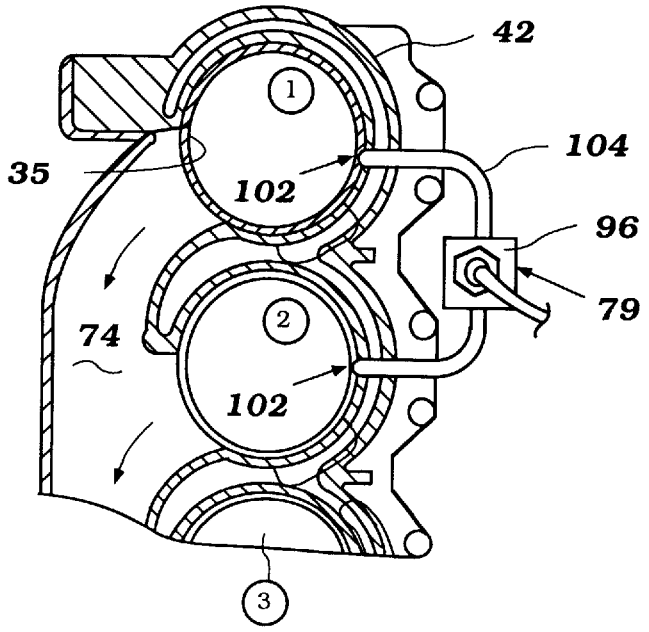
FIG. 10 is a cross-sectional view taken through one cylinder bank and shows another embodiment of the invention.
Figure 11:
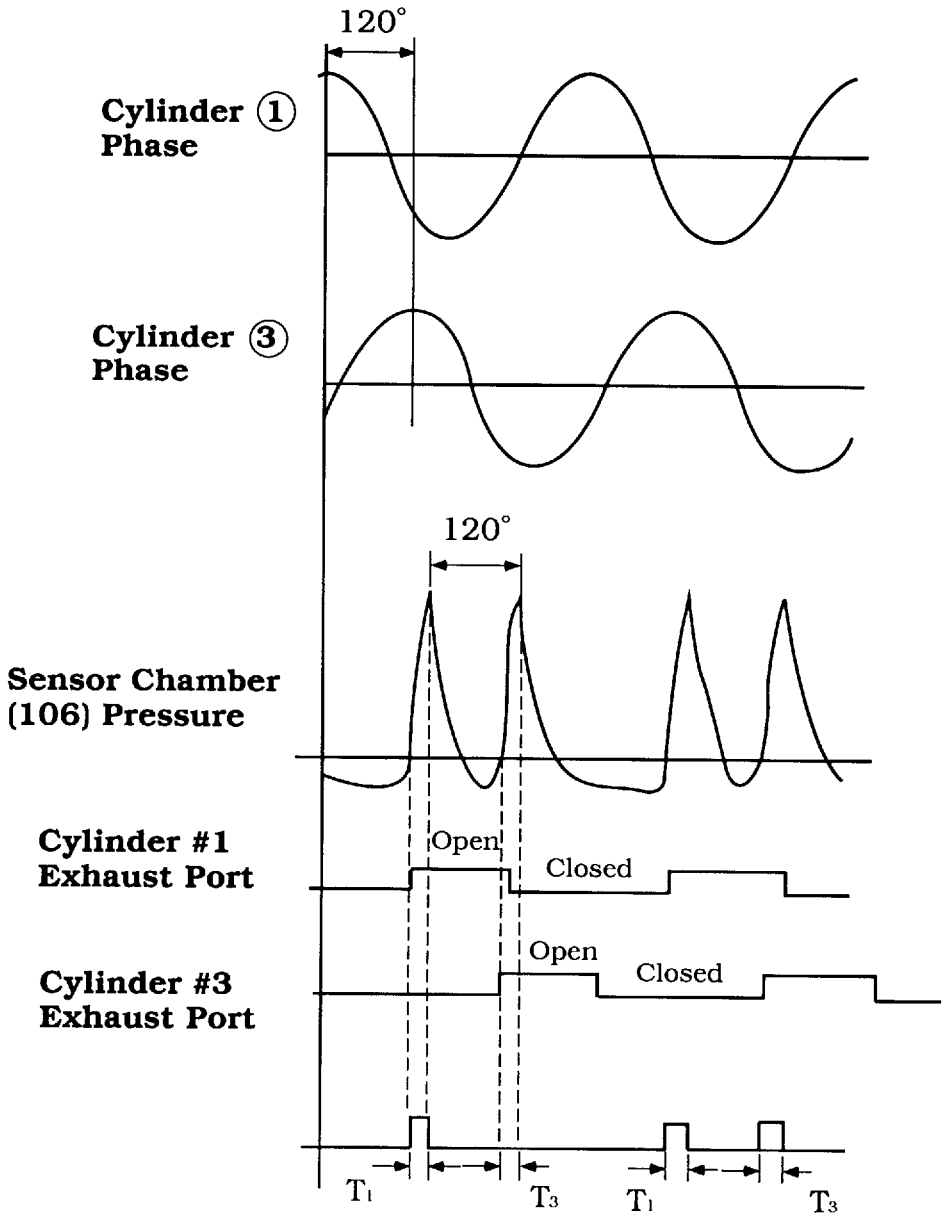
FIG. 11 is a timing diagram, in part similar to FIG. 9, but shows the conditions for this embodiment.

FIGS. 10 and 11 show another embodiment of the invention which is basically the same as the embodiment previously described. However, in this embodiment further purging of the sensor chamber 106 is assured by connecting this chamber to not only the number 1 cylinder but also the number 3 cylinder, these being cylinders that are 120° out of phase with each other as seen by the pressure curves in FIG. 11. As will be seen, the pressure in the chamber 106 reaches two peaks which are 120° out of phase with each other and which correspond with a time period after the exhaust port has opened for their respective cylinders. In this embodiment, it is possible to take readings for two cylinders and thus obtain better overall data for the engine control by taking readings at the times T1 and T3.

Figure 12:
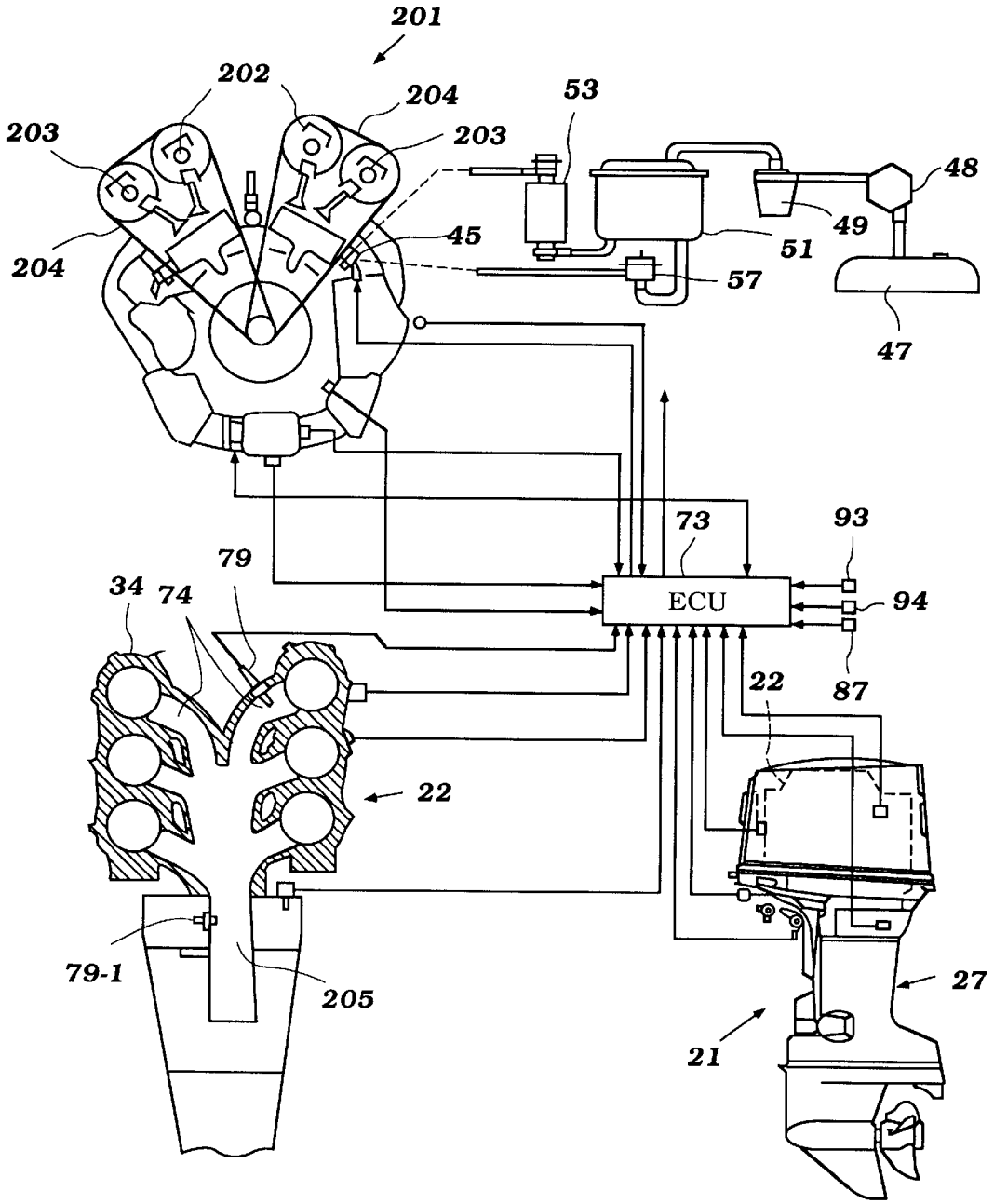
FIG. 12 is a view, in part similar to FIG. 1, and shows another embodiment of the invention, specifically applied to a four-cycle engine.

It has been noted that the invention can be utilized also with 4-cycle engines. FIG. 12 is a single view in part similar to FIG. 1, but the engine, indicated by the reference numeral 201 in this figure, is of the 4-cycle type. As may be seen, the engine has twin overhead cam shafts on each cylinder bank comprised of intake cam shafts 202 and exhaust cam shafts 203. These cam shafts are driven from the crankshaft 23 by timing chains or belts 204. In this embodiment, the fuel injectors 45 are of the direct type and hence inject directly into the combustion chambers of the engine. The bulk of the remaining system is the same as that previously described and, therefore, components which are the same or substantially the same as the previously describe embodiment have been identified by the same reference numerals.

In this embodiment, the sensor 79 may be mounted in one of the exhaust manifolds 74 or may be mounted in a single exhaust pipe 205 that collects the exhaust gases from these manifolds. This alternative location is shown as 79-1 in FIG. 12. In either event the output signal taken from it is taken only at the time when the exhaust port of one cylinder is open and the exhaust gases will have reached the sensor 79.

Figure 13:
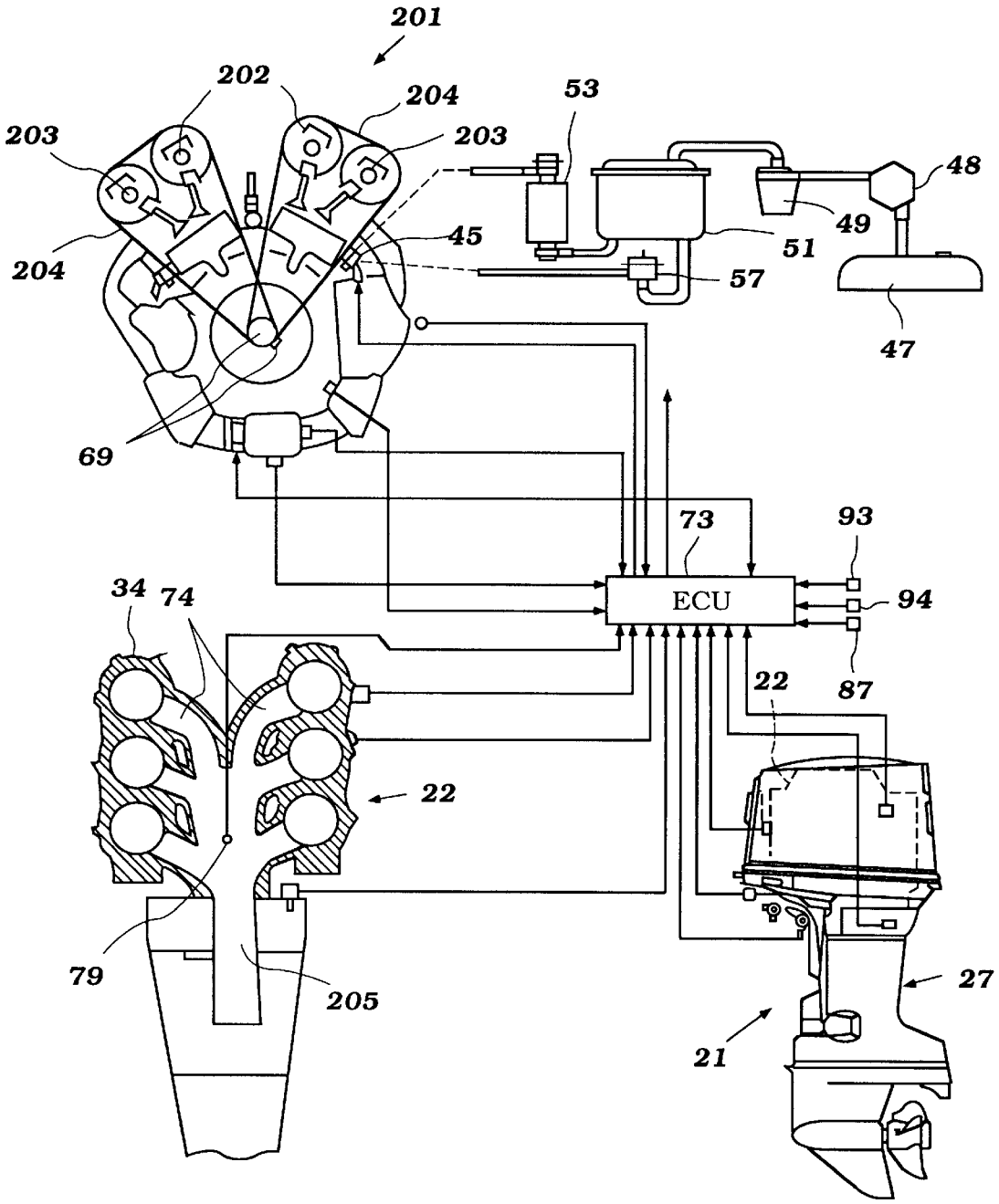
FIG. 13 is a view, in part similar to FIGS. 1 and 12, and shows another embodiment also applied to a four-cycle engine.

FIG. 13 shows another four cycle embodiment with the sensor 79 in a common part of the exhaust manifold. This is possible because of the lesser overlap in intake and exhaust timing overlap in four cycle engines.

In the embodiments of FIGS. 12 (79-1) and 13 there have been illustrated embodiments where the sensor 79 is placed in a common portion of the exhaust system that serves all cylinders. When this is done, that one sensor can sense the conditions in each cylinder so that each cylinder's fuel injector 45 may be controlled independently of the others. By timing the taking of the output signal from the sensor 79 to coincide with the time the exhaust gases reach the sensor 79 after the respective exhaust port opens this is possible. The output of the crankshaft position sensor 69 is used to determine and measure these times. Of course, the foregoing description is that of preferred embodiments of the invention, and various changes and modifications may be made without departing from the spirit and scope of the invention, as defined by the appended claims.

What is claimed is:

1. An internal combustion engine comprising a combustion chamber, an induction and charge-forming system for supplying fuel and air to said combustion chamber through an inlet port, means for igniting the charge in said combustion chamber for initiating combustion therein, exhaust means discharging exhaust gases from said combustion chamber through an exhaust port to the atmosphere, a combustion condition sensor for sensing the combustion condition in said combustion chamber and providing an output signal indicative of the combustion condition, feedback control means for controlling said charge-forming system for varying the fuel/air ratio supplied to said combustion chamber in response to the output signal from the combustion condition sensor, and means for reading the condition of the combustion chamber gases only at a time when said exhaust port is initially opened.

2. An internal combustion engine as set forth in claim 1, wherein the reading of the condition of the combustion chamber gases is terminated before the inlet port is opened.

3. An internal combustion engine as set forth in claim 1, wherein the combustion condition sensor is positioned in a sensor chamber that communicates with the combustion chamber through a sensor port.

4. An internal combustion engine as set forth in claim 3, wherein the sensor port communicates with the combustion chamber for a longer period than the reading period.

5. An internal combustion engine as set forth in claim 1, wherein the engine operates on a two cycle principle.

6. An internal combustion engine as set forth in claim 5, wherein the reading of the condition of the combustion chamber gases is terminated before the inlet port is opened.

7. An internal combustion engine as set forth in claim 5, wherein the combustion condition sensor is positioned in a sensor chamber that communicates with the combustion chamber through a sensor port.

8. An internal combustion engine as set forth in claim 7, wherein the sensor port communicates with the combustion chamber for a longer period than the reading period.

9. An internal combustion engine as set forth in claim 8, wherein the sensor port communicates with the combustion chamber for a period beginning before the exhaust port opens and ending after the exhaust port closes and during the entire time the inlet port is open.

10. An internal combustion engine as set forth in claim 1, wherein the engine has a plurality of combustion chambers and the combustion condition sensor is read for a period when the exhaust ports of at least two combustion chambers on different timing phases are opened.

11. An internal combustion engine as set forth in claim 10, wherein a single combustion condition sensor senses both of the combustion chambers.

12. A method of operating an internal combustion engine comprising a combustion chamber, an induction and charge-forming system for supplying fuel and air to said combustion chamber through an inlet port, means for igniting the charge in said combustion chamber for initiating combustion therein, exhaust means discharging exhaust gases from said combustion chamber through an exhaust port to the atmosphere, a combustion condition sensor for sensing the combustion condition in said combustion chamber and providing an output signal indicative of the combustion condition, feedback control means for controlling said charge-forming system for varying the fuel/air ratio supplied to said combustion chamber in response to the output signal from the combustion condition sensor, said method comprising the step of reading the condition of the combustion chamber gases only at a time when said exhaust port is initially opened.

13. A method of operating an internal combustion engine as set forth in claim 12, wherein the reading of the condition of the combustion chamber gases is terminated before the intake port is opened.

14. A method of operating an internal combustion engine as set forth in claim 12, wherein the combustion condition sensor is positioned in a sensor chamber that communicates with the combustion chamber through a sensor port.

15. A method of operating an internal combustion engine as set forth in claim 14, wherein the sensor port communicates with the combustion chamber for a longer period than the reading period.

16. A method of operating an internal combustion engine as set forth in claim 12, wherein the engine operates on a two cycle principle.

17. A method of operating an internal combustion engine as set forth in claim 16, wherein the reading of the condition of the combustion chamber gases is terminated before the inlet port is opened.

18. A method of operating an internal combustion engine as set forth in claim 16, wherein the combustion condition sensor is positioned in a sensor chamber that communicates with the combustion chamber through a sensor port.

19. A method of operating an internal combustion engine as set forth in claim 18, wherein the sensor port communicates with the combustion chamber for a longer period than the reading period.

20. A method of operating an internal combustion engine as set forth in claim 19, wherein the sensor port communicates with the combustion chamber for a period beginning before the exhaust port opens and ending after the exhaust port closes and during the entire time the inlet port is open.

21. A method of operating an internal combustion engine as set forth in claim 12, wherein the engine has a plurality of combustion chambers and the combustion condition sensor is read for a period when the exhaust ports of at least two combustion chambers on different timing phases are opened.

22. A method of operating an internal combustion engine as set forth in claim 21, wherein a single combustion condition sensor is utilized for sensing the combustion in both of the combustion chambers.

* * * * *